US006176760B1

(12) United States Patent
Ngai

(10) Patent No.: US 6,176,760 B1
(45) Date of Patent: Jan. 23, 2001

(54) TOY RACING CAR TRACK BRIDGE

(75) Inventor: Kam Fai Ngai, Shatin (HK)

(73) Assignee: Artin Industrial Co., Ltd., Kowloon (HK)

( * ) Notice: Under 35 U.S.C. 154(b), the term of this patent shall be extended for 0 days.

(21) Appl. No.: 09/360,163

(22) Filed: Jul. 26, 1999

(51) Int. Cl.[7] ..... A63H 18/00
(52) U.S. Cl. ..... 446/444; 446/484; 446/487
(58) Field of Search ..... 446/91, 108, 228, 446/444, 445, 446, 476, 477, 484, 487

(56) References Cited

U.S. PATENT DOCUMENTS 2,821,938 * 2/1958 Muller ..... 446/444
3,722,131 * 3/1973 Rossi ..... 446/476
4,386,777 * 6/1983 Prehodka ..... 446/444 X
4,726,515 * 2/1988 Bolli et al. ..... 446/444 X
5,102,133 * 4/1992 Chilton et al. ..... 446/444
5,405,080 * 4/1995 Yeung et al. ..... 446/446 X
5,628,670 * 5/1997 Hill ..... 446/487
5,678,489 * 10/1997 Wang ..... 446/444 X
5,848,503 * 12/1998 Toft et al. ..... 446/91 X

* cited by examiner

*Primary Examiner*—Sam Rimell
(74) *Attorney, Agent, or Firm*—Leydig, Voit & Mayer

(57) ABSTRACT

A bridge for use in a toy racing car track system including a loop of track sections connected together, end-to-end to form at least one lane for an electric toy car, the track sections including a groove for guiding the movement of the toy car and a pair of conductive rails on opposite sides of the groove for supplying electrical power to the toy car. The bridge includes a flexible body having a series of interconnected links and a pair of supports at opposite ends of and supporting the body and connecting the body to other track sections. The body and supports have a guiding groove and pair of conductive rails.

10 Claims, 3 Drawing Sheets

200
220
212/212B (X14)
213
212/212A (X1)
220

200
218
218
210
218
224
222
224
220
A
310
330
212/212B (X14)
212/212A (X1)
220

213
217
216
214
215
320
310
224
222
226
220
212/212A
212/212B
330

TOY RACING CAR TRACK BRIDGE

The present invention relates to a bridge for use in an electric toy racing car track system.

BACKGROUND OF THE INVENTION

In a conventional construction, an electric toy racing car track system is formed by a loop of track sections which are connected end-to-end together to form a pair of co-extending lanes for respective toy cars to race with each other. Each lane is provided with a central groove for guiding a respective toy car by its bottom guide pin and a pair of conductive rails on opposite sides of the guiding groove for supplying electrical power to the toy car via respective brush contacts on the bottom of the car. The track system may sometimes include an elevated portion, in the form of a bridge or flyover, for crossing over another portion below it.

The subject invention seeks to provide a bridge for use in a toy racing car track system, which adds variation and fun to the game.

SUMMARY OF THE INVENTION

According to the invention, there is provided a bridge for use in a toy racing car track system formed by a loop of track sections connected end-to-end together to form at least one lane for an electric toy car to run along and including a groove for guiding the movement of and a pair of conductive rails on opposite sides of the groove for supplying electrical power to the toy car, which bridge comprises a flexible body formed by a series of interconnected links and a pair of supports provided at opposite ends of and for supporting the body and for connection to the other track sections of the system, said body and supports having a said guiding groove and pair of power supply rails.

Preferably, the links are pivotably connected together by means of laterally extending hinge pins between each pair of adjacent links.

More preferably, each pair of adjacent links are formed with complementary side protrusion and recess in engagement.

It is preferred that the links are connected together with a narrow gap formed between adjacent links.

It is preferred that the link at each end of the body and the end of the adjacent support are formed with said complementary side protrusion and recess in engagement.

Advantageously, a spring is provided between each pair of adjacent links to enable the body to sag in a smoothly contoured manner.

In a preferred embodiment, the power supply rails of the body are provided by respective conductive helical springs extending across the links.

More preferably, the body is formed with a pair of grooves on opposite sides of the guiding groove for locating the respective springs, each of said side grooves having a part-circular cross-section which extends over an angle exceeding 180° to form a restricted open top side for the groove for exposing the upper side of a respective spring to allow the spring to supply electrical power to a toy car.

Further more preferably, the springs are located through insertion endwise into the respective grooves of the interconnected links.

It is preferred that each end of the springs is connected to the adjacent end of the power supply rails of the supports by means of a conductive plug.

The invention also provides a toy car racing track system including the aforesaid bridge.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figures 1, 2:
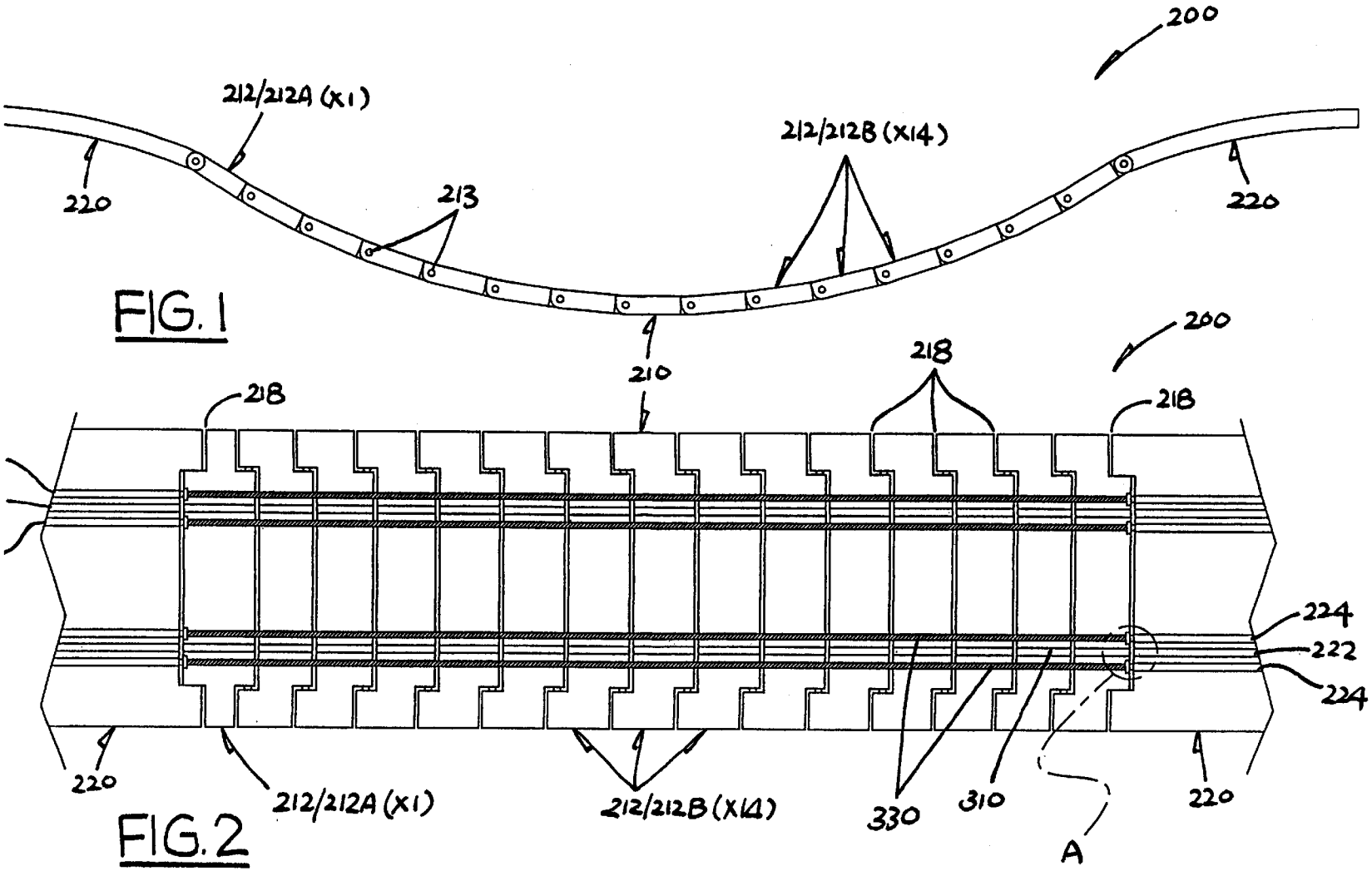
FIG. 1 is an elevational side view of a first embodiment of a toy racing car track bridge in accordance with the invention.
FIG. 2 is a top view of the bridge of FIG. 1.
Figures 3A, 3B, 3C, 3D, 3E, 3F:
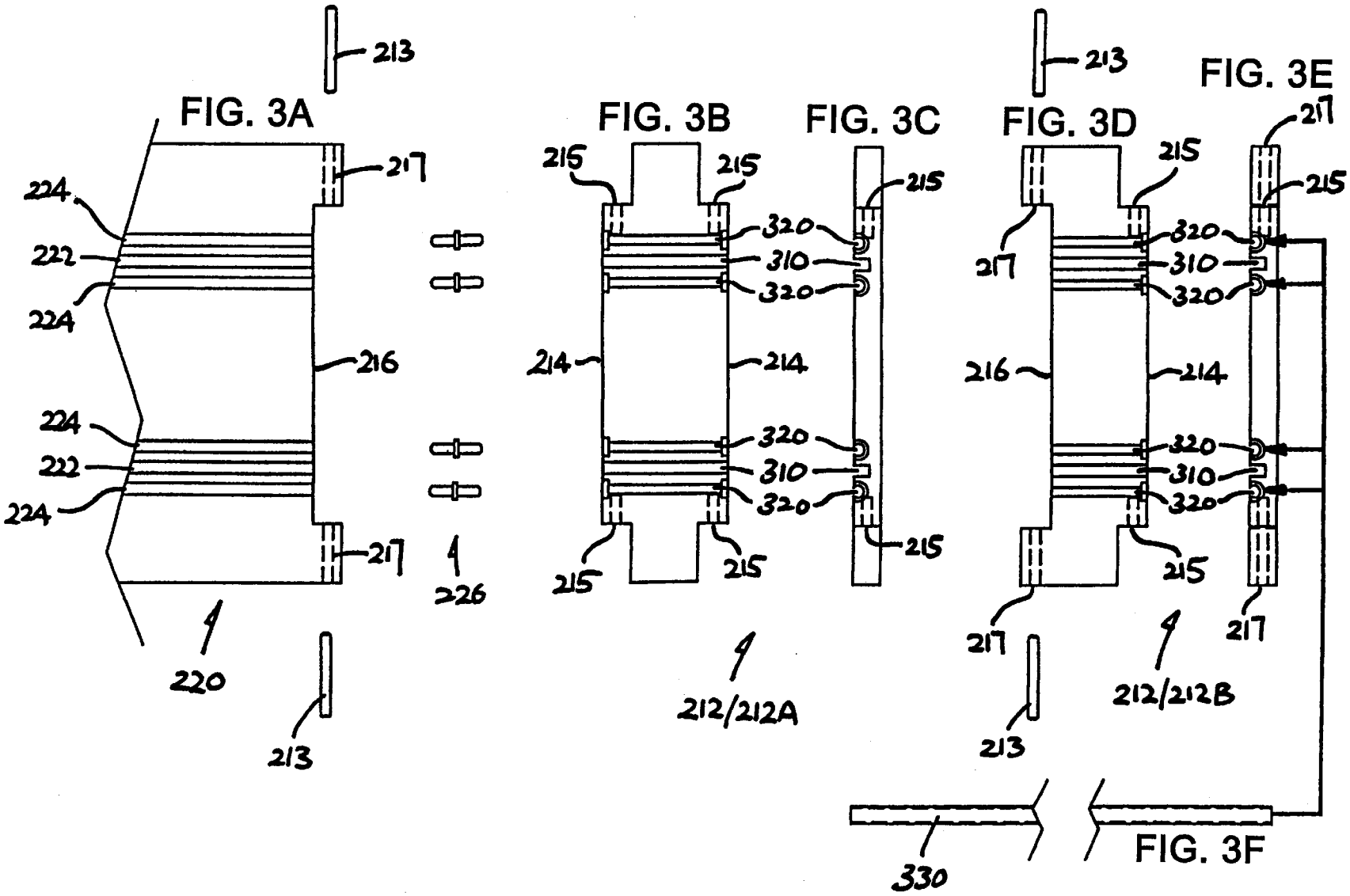
FIG. 3A is a plan view of a support section and end link.
FIG. 3B is a plan view and FIF. 3C is an end view of a central link.
FIG. 3D is a plan view and FIG. 3E is an end view of a central link.
FIG. 3F is an illustration of springs in grooves in the link of FIGS. 3D and 3E.
Figure 4:
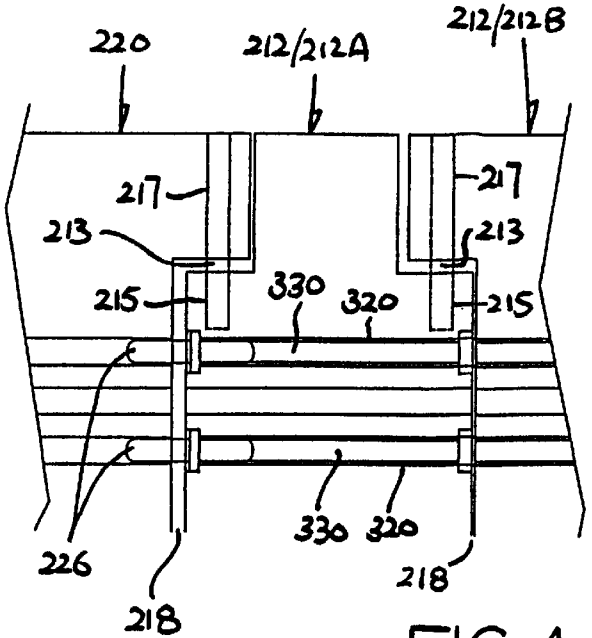
FIG. 4 is an enlarged top plan view of the key parts on one side of the bridge of FIG. 2.
Figure 5:
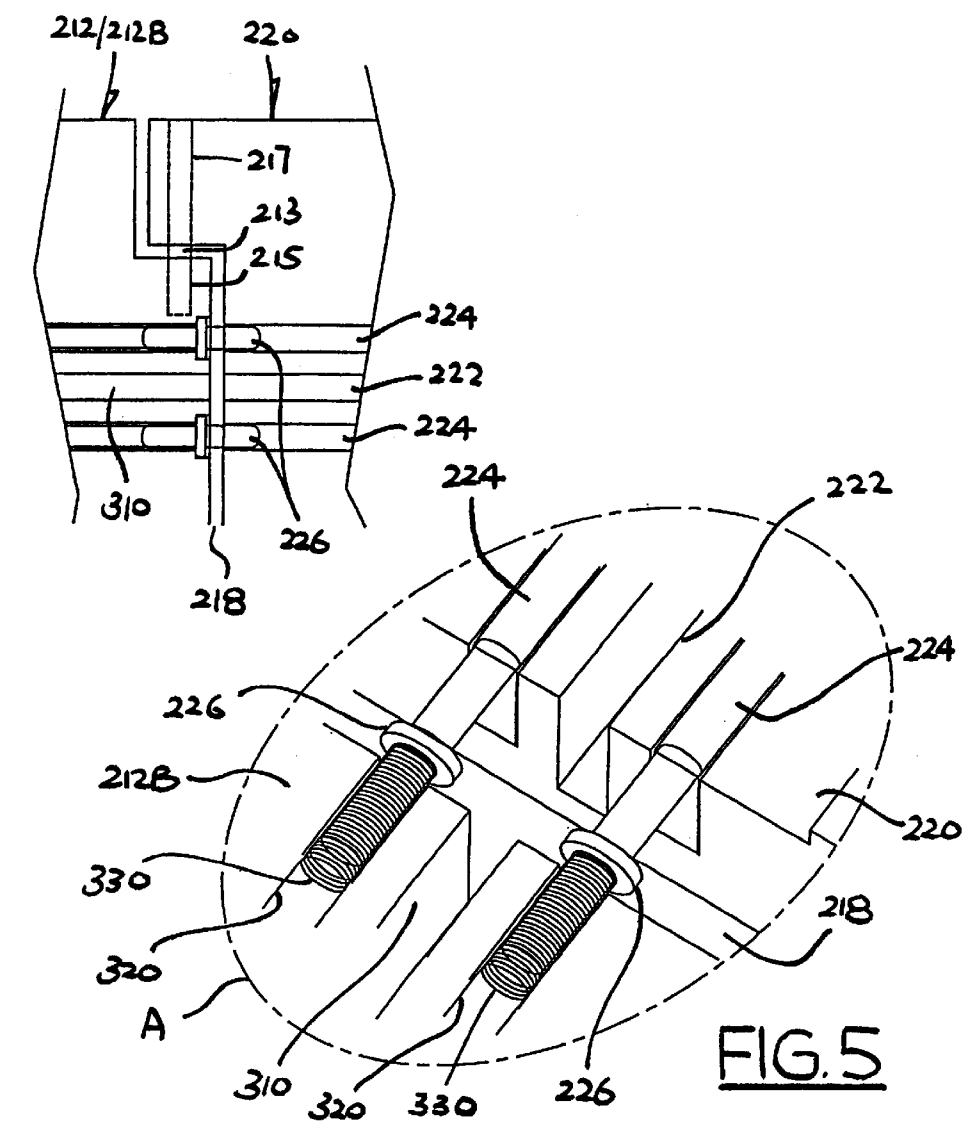
FIG. 5 is an enlarged perspective view showing the connection at one end of the bridge of FIG. 2.

Referring to the drawings, there is shown a bridge 200 embodying the invention, for use in a conventional electric toy car racing track system. The track system is typically constructed by a loop of track sections connected end-to-end together to form a pair of co-extending lanes for respective toy cars to race with each other. Extending along each lane, the track sections include a central groove for guiding the movement of a respective toy car by its bottom guide pin and a pair of conductive rails on opposite sides of the guiding groove for supplying electrical power to the toy car via respective contact brushes on the bottom of the car. Most of the track sections are constructed and interconnected in a conventional manner that is generally known in the art, except the bridge 200 which is a hanging bridge.

As part of an elevated portion of the track system, the bridge 200 is formed by a body track section 210 which is flexible and sagging and a pair of support track sections 220 which are rigid and curved slightly downwards. The body section 210 is supported at opposite ends by the support sections 220, which are, in turn, connected at their outer ends to the other conventional track sections in a known manner.

The body section 210 includes a series of fifteen transversely extending links 212 interconnected together. Apart from the leftmost link 212A, each of the other links 212B has a central rectangular recess 216 on the left side and a complementary central rectangular protrusion 214 on the right side for fitting into the recess 216 of an adjacent link 212B. The link 212A has a pair of such protrusions 214 on opposite sides. Each protrusion 214 includes a pair of aligned blind holes 215 extending laterally on opposite sides. Each recess 216 has a pair of through holes 217 extending laterally on opposite sides.

All the links 212A and 212B are fitted successively together, with the respective pairs of adjacent protrusions 214 and recesses 216 in engagement such that each pair of adjacent side holes 215 and 217 are mutually aligned. A hinge pin 213 is inserted into each pair of the aligned side holes 215 and 217, whereby the links 212A and 212B are pivotably connected loosely together, with a narrow gap 218 between adjacent links 212, forming the flexible body section 210. While in isolation, the body section 210 has protrusions 214 at opposite ends exposed.

Extending along each lane and across the links 212, the body section 210 includes a central groove 310 for guiding a respective toy car as described above and a pair of additional grooves 320 on opposite sides of the central groove 310 for locating respective conductive helical springs 330. Each groove 320 has a part-circular cross-section which extends over an angle exceeding 180°, forming a restricted open top side for the groove 320 and exposing the upper side of the respective spring 330 so the spring 330 supplies electrical power to a toy car as described above. The springs 330 also impart a certain degree of resilience between each pair of adjacent links 212 to enable the interconnected links 212 or the body section 210 to sag in a smoothly contoured manner. The springs 330 are inserted endwise into the respective grooves 320 after the links 212 have been connected together.

The two support sections 220 have a construction similar to that of the other conventional track sections, including, along each lane, a central guiding groove 222 and a pair of power supply rails 224 on opposite sides of the guiding groove 222. The inner end of each support section 220 includes a central recess 216 with side holes 217. In order to support the body section 210, each support section 220 is pivotably connected at its inner end with the respective end of the body section 210, through fitting of the recess 216 of the former and the protrusion 214 of the latter and the use of two hinge pins 213 on opposite sides, in the same manner as described between adjacent links 212.

Two pairs of conductive double-ended plugs 226 are used at the junction between each support section 220 and the body section 210 for joining together the support section rails 224 and the aligned body section springs 330 for completing the power supply circuit. The guiding grooves 222 and 310 are aligned with each other for continuity.

In operation, a toy car arriving at one end of the bridge 200 runs onto the near support section 220 and subsequently past the body section 210 onto the other support section 220, and finally leaves from the opposite end of the bridge 200. During transit, the weight and momentum of the toy car causes the body section 210 to sway slightly up-and-down, thereby adding variation as well as fun to the game.

The invention has been given by way of example only, and various modifications of and/or alterations to the described embodiment may be made by persons skilled in the art without departing from the scope of the invention as specified in the appended claims.

What is claimed is:

1. A bridge for use in a toy racing car track system including a loop of track sections connected end-to-end, forming at least one lane for an electric toy car, the track sections including a groove for guiding movement of the electric toy car and a pair of electrically conductive rails on opposite sides of the groove for supplying electrical power to the electric toy car, the bridge comprising:

a flexible body including a plurality of interconnected links;

laterally extending hinge pins extending between and pivotably connecting each adjacent pair of links; and a pair of supports at opposite ends of the flexible body, supporting the body and connecting the body to the track sections, the body and the supports each having a guiding groove and a pair of electrically conductive rails.

2. The bridge as claimed in claim 1, wherein each link includes, at opposite sides, complementary protrusions and recesses, protrusions of one link engaging the recesses of an adjacent link.

3. The bridge as claimed in claim 1 wherein a narrow gap is present between each adjacent pair of links.

4. The bridge as claimed in claim 2, wherein links at each end of the body and at ends of supports adjacent the body include, at opposite sides, complementary protrusions and recesses, protrusions of a first link engaging recesses at a first end of the body and protrusions at a second end of the body engaging recesses of a second of the links.

5. A bridge for use in a toy racing car track system including a loop of track sections connected together, end-to-end, forming at least one lane for an electric toy car, the track sections including a groove for guiding movement of the electric toy car and a pair of electrically conductive rails on opposite sides of the groove for supplying power to the electric car, the bridge comprising:

a flexible body including a plurality of interconnected links;

a pair of supports at opposite ends of the flexible body, supporting the flexible body and connecting the body to the track sections, the body and the supports each having a guiding groove and a pair of electrically conductive rails; and a plurality of springs, one of the springs being located between each adjacent pair of links permitting sagging of the flexible body in a smooth contour.

6. A bridge for use in a toy racing car track system including a loop of track sections connected together, end-to-end, forming at least one lane for an electric toy car, the track sections including a groove for guiding movement of the electric toy car and a pair of electrically conductive rails on opposite sides of the groove for supplying power to the electric car, the bridge comprising:

a flexible body including a plurality of interconnected links;

a pair of supports at opposite ends of the flexible body, supporting the flexible body and connecting the body to the track sections, the body and the supports each having a guiding groove and a pair of electrically conductive rails; and respective electrically conductive helical springs extending across each adjacent pair of links as the electrically conductive rails of body.

7. The bridge as claimed in claim 6, wherein the flexible body includes a pair of side grooves on opposite sides of the guiding groove for locating the respective electrically conductive helical springs, each of the side grooves having a partially circular cross-section extending over an angle exceeding 180° and forming a restricted open side the groove, exposing a side of a respective electrically conductive helical spring supplying electrical power to the toy car.

8. The bridge as claimed in claim 7, wherein the electrically conductive helical springs are arranged endwise in respective grooves of each adjacent pair of links.

9. The bridge as claimed in claim 7, including conductive plugs, wherein ends of the electrically conductive helical springs are connected to adjacent ends of the electrically conductive rails of the supports by respective conductive plugs.

10. A toy car racing system including:

a loop of track sections connected together, end-to-end, forming at least one lane for an electric toy car, the track sections including a groove for guiding movement of the electric toy car and a pair of electrically conductive rails on opposite sides of the groove for supplying electrical power to the electric toy car; and a bridge having a flexible body and including a plurality of interconnected links;

laterally extending hinge pins extending between and pivotably connecting each adjacent pair of links; and a pair of supports at opposite ends of the flexible body, supporting the body and connecting the body to the track sections, the body and the supports each having a guiding groove and a pair of electrically conductive rails.

* * * * *